US009546828B2

(12) United States Patent
Moreau et al.

(10) Patent No.: US 9,546,828 B2
(45) Date of Patent: Jan. 17, 2017

(54) ASSEMBLY OF TWO PARTS CRIMPED ONE OVER THE OTHER

(75) Inventors: Laurent Moreau, Reims (FR); Francois Beideler, Reims (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 306 days.

(21) Appl. No.: 13/992,256

(22) PCT Filed: Dec. 6, 2011

(86) PCT No.: PCT/EP2011/071847

§ 371 (c)(1),
(2), (4) Date: Aug. 14, 2013

(87) PCT Pub. No.: WO2012/076495

PCT Pub. Date: Jun. 14, 2012

(65) Prior Publication Data

US 2013/0333867 A1 Dec. 19, 2013

(30) Foreign Application Priority Data

Dec. 7, 2010 (FR) ..... 10 60163

(51) Int. Cl.
*F28F 9/02* (2006.01)
*F28F 9/00* (2006.01)
(Continued)

(52) U.S. Cl.
CPC ..... *F28F 9/00* (2013.01); *B21D 39/02* (2013.01); *B21D 53/08* (2013.01); *F28F 9/02* (2013.01);
(Continued)

(58) Field of Classification Search
CPC ..... B21D 39/02; B21D 53/08; F28F 9/02; F28F 9/0224; F28D 1/05366; F28D 2021/0084
(Continued)

(56) References Cited

U.S. PATENT DOCUMENTS 5,107,926 A * 4/1992 Calleson ..... F28D 1/05383 165/153
5,226,490 A * 7/1993 Ryan et al. ..... 165/173
(Continued)

FOREIGN PATENT DOCUMENTS

EP 0374896 A2 6/1990
EP 0676607 A1 11/1995
(Continued)

OTHER PUBLICATIONS

English language abstract and translation for EP 0374896 extracted from espacenet.com database on Oct. 31, 2013, 15 pages.
(Continued)

*Primary Examiner* — Tho V Duong
(74) *Attorney, Agent, or Firm* — Howard & Howard Attorneys PLLC

(57) ABSTRACT

The invention relates to an assembly of two parts crimped together by folding at least one portion of peripheral edge (12) of one so-called first part (8) over the other so-called second part (9). Said first part (8) has a hinge-forming region facilitating the folding of said portion of peripheral edge (12). The invention also relates to a manifold comprising said assembly and a heat exchanger comprising said manifold.

8 Claims, 2 Drawing Sheets

(51) Int. Cl.

| | |
|---|---|
| ***B21D 39/02*** | (2006.01) |
| ***B21D 53/08*** | (2006.01) |
| *F28D 1/053* | (2006.01) |
| *F28D 21/00* | (2006.01) |

(52) U.S. Cl.
CPC ..... *F28F 9/0224* (2013.01); *F28D 1/05366* (2013.01); *F28D 2021/0084* (2013.01)

(58) Field of Classification Search
USPC ..... 165/173
See application file for complete search history.

(56) References Cited

U.S. PATENT DOCUMENTS

| | | | | |
|---|---|---|---|---|
| 5,236,044 | A * | 8/1993 | Nagasaka et al. | 165/176 |
| 5,450,896 | A * | 9/1995 | Bertva et al. | 165/173 |
| 5,727,626 | A * | 3/1998 | Kato | 165/173 |
| 6,892,804 | B2 * | 5/2005 | Nozaki | F02B 29/0456 165/173 |
| 2007/0074860 | A1 * | 4/2007 | Shinhama | F28D 1/05375 165/173 |
| 2008/0121386 | A1 * | 5/2008 | Hakamata et al. | 165/173 |
| 2010/0263850 | A1 * | 10/2010 | Huang | F28F 3/02 165/185 |
| 2013/0000876 | A1 * | 1/2013 | Lavenu et al. | 165/173 |

FOREIGN PATENT DOCUMENTS

| | | | |
|---|---|---|---|
| GB | 2197810 | A | 6/1988 |
| WO | WO 82/03574 | A1 | 10/1982 |

OTHER PUBLICATIONS

International Search Report for Application No. PCT/EP2011/071847 dated Jan. 6, 2012, 5 pages.

* cited by examiner

ASSEMBLY OF TWO PARTS CRIMPED ONE OVER THE OTHER

RELATED APPLICATIONS

This application is the National Stage of International Patent Application No. PCT/EP2011/07847, filed on Dec. 6, 2011, which claims priority to and all the advantages of French Patent Application No. FR 10/60163, filed on Dec. 7, 2010, the content of which is incorporated herein by reference.

The invention relates to an assembly of two parts crimped together, a manifold comprising said assembly and a heat exchanger comprising said manifold.

Although not exclusively, the heat exchangers concerned are intended to be installed in vehicles and correspond, in a preferential application, to the condensers provided on the air conditioning loops or circuits of the vehicles. However, other applications of these heat exchangers can also be envisaged without departing from the framework of the invention.

BACKGROUND

Condensers are known comprising a bundle of parallel tubes and two manifolds in which the corresponding ends of the tubes are connected, in a fixed and leak-tight manner. Thus, the fluid of the air conditioning loop can circulate from one manifold to the other, through the tubes in which the fluid changes from the vapor phase to the liquid phase through heat exchange with a flow of air, sweeping over the tubes. These exchangers are assembled by brazing.

The manifolds comprise a collector plate with a longitudinally open wall and a cover closing the collector plate, after brazing. To pre-assemble the cover and the collector plate before brazing, it is known practice to crimp them. For this, the collector plate has raised edges of which a peripheral portion is crimped around the cover to close the manifold.

These known manifolds present the drawback of having to apply, to the portion of peripheral edge of the collector plate, an excessively high force during the crimping operation and of thus risking deforming the cover, which could prevent the cover and the collector plate from being brazed correctly.

One solution for avoiding the problems of deformation in the crimping operation is to use a counter-form, called "fork", that makes it possible to prevent the transmission of the crimping forces to the cover. Such a solution remains complicated to implement because it requires specific tooling.

The aim of the invention is to overcome the abovementioned problems.

SUMMARY OF THE INVENTION

To this end, it proposes an assembly of two parts crimped together by folding at least one portion of peripheral edge of one, so-called first part, over the other, so-called second part. According to the invention, said first part has a hinge-forming region facilitating the folding of said portion of peripheral edge.

The force that has to be applied to said portion of peripheral edge when crimping said first part onto said second part will thus be less great and will reduce the risk of deformation of the manifold. In addition, it will be able to be implemented without a part serving as counter-form.

According to different embodiments, said portion of peripheral edge has a thinned portion relative to another portion of the first part, intended to offer a resistance to the pressure of a fluid. Said hinge region is defined in this way.

For example, the thinned portion can extend from said hinge region to the distal edge of said first part.

Said first part having a longitudinal extension dimension, the thinned portion is, for example, continuous along said longitudinal extension.

Advantageously, a start of fold can be provided at the level of said hinge region, for example situated at the level of a base of said thinned portion.

Preferably, said thinned portion has a thickness of between 25% and 75% of the thickness of the other portion.

In particular, it can have a thickness of between 40% and 60% of the thickness of the other portion.

The invention also relates to a manifold of a heat exchanger comprising a collector plate and a cover, said collector plate constituting said first part and said cover constituting said second part of the assembly as defined above.

Preferably, said manifold comprises a U-shaped cover with a base and longitudinal wings linked to the base by an incurved region. The hinge region is facing the wings in proximity to the incurved region.

The invention also relates to a heat exchanger, in particular a condenser of a motor vehicle air conditioning system, provided with a manifold as defined above.

The appended figures will give a good understanding as to how the invention can be produced. In these figures, identical references designate similar elements.

DETAILED DESCRIPTION

Figure 1:
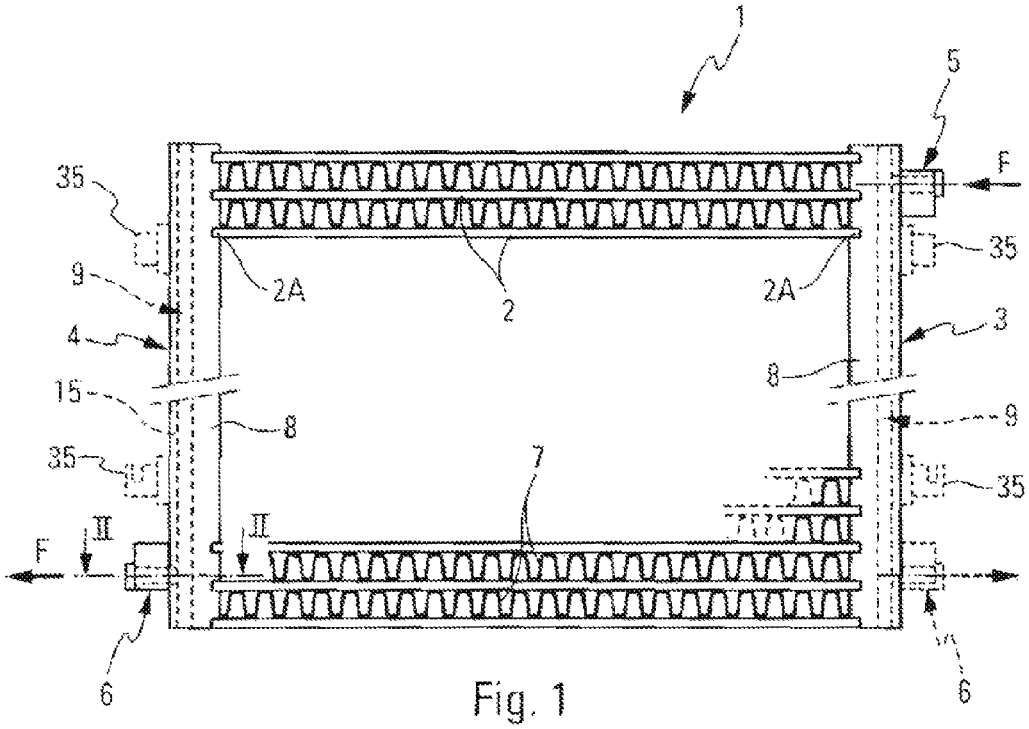
FIG. 1 is a plan schematic view of an exemplary embodiment of a heat exchanger whose manifolds comprise a collector plate and a cover according to the invention.

The invention will be able to be applied in a heat exchanger as represented in FIG. 1. This exchanger is, for example, a condenser of an air conditioning loop for the passenger compartment of a vehicle.

The exchanger 1 will be able to comprise a bundle of parallel tubes 2 whose ends 2A are linked, in a fixed and leak-tight manner, to manifolds or collector boxes, respectively upstream 3 and downstream 4 depending on the direction of circulation of the fluid, in particular Freon, circulating in the loop concerned. Inlet 5 and outlet 6 fluidic connection flanges are respectively added to these manifolds.

In particular, the tubes 2 in which the fluid circulates have an oblong transversal section and separators 7, increasing the heat exchange surface area between the fluid circulating in the exchanger 1 and the external flow of air passing through it, are arranged between them. The interior of the tubes 2 can also include disturbing elements which, like the separators, increase the heat exchange surface area and the mechanical strength of the tubes. There may also be extruded tubes. Each tube defines, for example, a plurality of parallel, internal fluid circulation channels.

The upstream 3 and downstream 4 manifolds are substantially identical and have a generally tubular form. They are of "bipartite" type, that is to say that each of them consists of a collector plate 8 and a cover 9.

Figure 2:
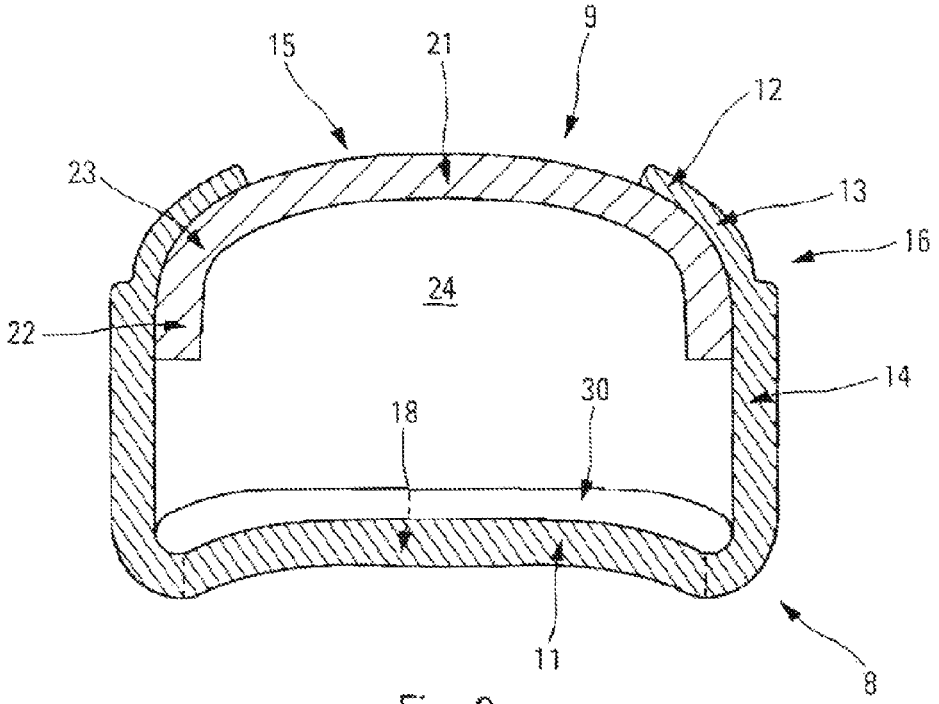
FIG. 2 is a transversal cross-section of the manifold after the collector plate has been crimped around the cover.

The exemplary assembly of two parts crimped together, according to the invention and represented in FIG. 2, is a heat exchanger manifold as described above. The first part represented is a collector plate 8 and the second, a cover 9 for said manifolds.

The collector plate 8 has, for example, a substantially U-shaped transversal section and its wall thus defines a bottom 11 prolonged by two parallel, lateral branches or wings 14, of which the distal end of the peripheral edges delimit a longitudinal opening 15 blocked by the cover in the figure. In the bottom 11 of the collector plate 8, oblong slots 18 are formed all along it, in which are received the corresponding ends of the parallel tubes 2. They will be able to be edged by collars 30.

The cover 9 has, for example, also, a U-shaped transversal section of which the wall 20 forms a slightly concave bottom 21 prolonged by parallel, lateral branches or wings 22, shorter than those of the collector plate 8. The dimension, notably widthwise, of the cover, is such that the lateral branches 22 fit head-to-tail between the lateral branches 14 of the collector plate 8.

The assembly of the cover 9 and of the collector plate 8 defines an internal space 24 in which the fluid of the loop is made to circulate. Through the fitted-together form of the Us of the plate 8 and of the cover 9, the transversal section of the manifold 3 or 4 is approximately rectangular, but could be different.

Partitions, not represented, are optionally provided at each of the longitudinal ends of the manifold to close the manifold. Intermediate partitions, that can render two parts of the manifold airtight from one another, can also be provided. These partitions comprise, for example, an abutment for the positioning of the cover 9.

To refer once again to FIG. 1, it can be seen that the inlet 5 and outlet 6 flanges are provided on, respectively, the upstream and downstream manifolds. The two flanges 5, 6, in particular in the case of manifolds with internal separation partitions, could be located on the same tubular manifold 5, respectively at the ends thereof, as shown by the flange 6 in dotted lines in FIG. 1.

The function of the inlet 5 and outlet 6 flanges is to ensure the fluidic connections via pipes, not represented, between, in the example, a compressor of the loop concerned, facing toward the upstream manifold 3, and the interior space of the tubular upstream manifold 3, and between the interior space 24 of the tubular downstream manifold 4 and an expansion valve facing the latter, via fluid passages formed in the flanges.

For information, other flanges have been represented, by the reference 35, that are added on by crimping to the tubular manifolds 3, 4 and intended for the fastening of the exchanger 1 on appropriate supports of the vehicle and/or for the attachment of a fluid storage bottle in fluid communication with one of the manifolds.

The purpose of such a bottle, for example connected to the downstream manifold, is to ensure the filtering and the dehydration of the refrigerant, to compensate the variations of volume of the refrigerant and/or to ensure the separation of the portion of fluid which could be once again in gaseous phase at the outlet of the condenser from the fluid portion in liquid phase.

The crimping operation will be able to allow for the preassembly not only of the collector plate 8 and of the cover 9, but also of the fluid inlet 5 and outlet 6 flanges, the flanges 35 intended for the fastening of the exchanger 1 on appropriate supports of the vehicle and/or for the attachment of the fluid storage bottle. These elements are crimped, for example, between the cover 9 and the portion of peripheral edge 12 of the collector plate 8. A preassembly of all these elements is thus obtained in a single operation.

FIG. 2 illustrates more generally an assembly of two parts crimped together by folding at least one portion of peripheral edge 12 of one so-called first part, here the collector plate 8, over the other so-called second part, here the cover 9. In the example illustrated, the portion of peripheral edge 12, intended to be crimped, is situated at the level of a free end of the lateral wings 14 of the collector plate 8.

According to the invention, the crimping of the portion of peripheral edge 12 of said first part 8 onto the second part 9 is facilitated by the presence of a hinge region 16 on said first part 8.

The force required will therefore be less great for crimping said portion of peripheral edge 12 of said first part 8 onto said second part 9. This will make it possible not only to reduce the risk of deformation of the manifold but also to avoid the use of any part serving as counter-form.

Furthermore, in the case of a more complete preassembly where the bottle is preassembled between the collector plate and the cover to be crimped at the same time as them, the narrowness between the cover and the bottle entails using crimping plates of small section which can therefore break. By reducing the force required to crimp said portion of peripheral edge 12 of said first part 8 onto said second part 9, the risk of breaking the crimping plates of small section is also reduced.

Preferably, but not exclusively, the crimping is facilitated by the thinning of all or part of said portion of peripheral edge 12 of the first part 8 relative to another portion 14 of the first part, intended to offer a resistance to the pressure of a fluid, here the rest of the lateral wings 14 and the bottom 11 of the collector plate 8. The wall thinning is obtained by any appropriate mechanical operation (rolling, drawing, stamping, etc.).

In other words, the portion of peripheral edge 12, intended for the crimping, has a thinned portion 13, that is to say a portion whose material thickness is thinner than the material thickness in a portion of the first part intended to withstand the pressure of the fluid. In the example illustrated, the thinned portion 13 has a thickness less than that of the rest of the lateral wings 14 and/or of the bottom 11 of the collector plate 8.

Figure 3:
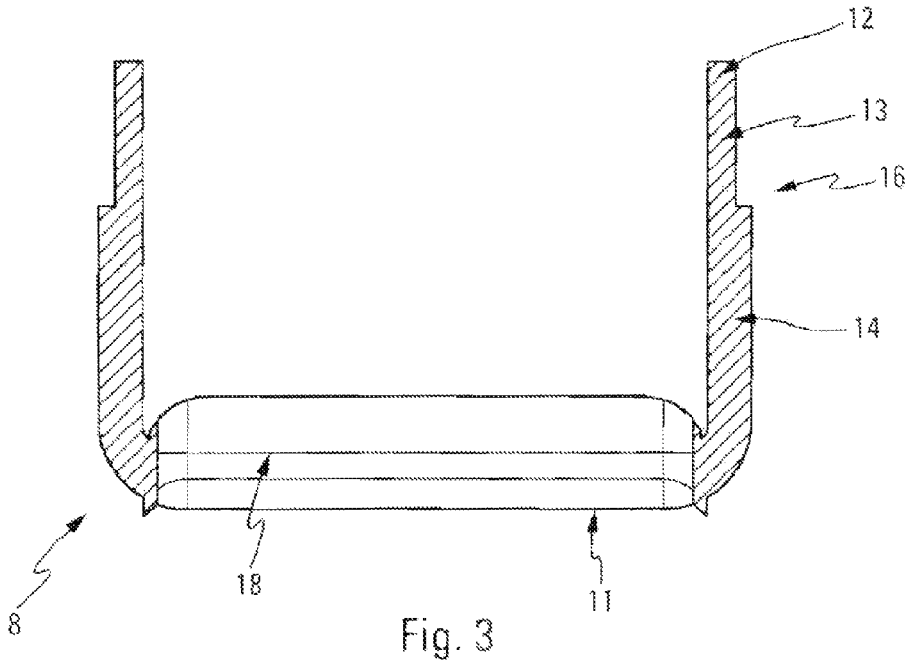
FIG. 3 is a transversal cross-section of the collector plate before the crimping operation.

FIG. 3 shows us a cross-sectional view of the first part 8 before the portion of peripheral edge 12 has been crimped around the second part 9. In this example, the thinned portion 13 extends from the hinge region to the distal edge of the first part. In other words, it covers all of the portion 12 intended for the crimping.

The thinned portion 13 can, in the case where, as in the example illustrated, the first part has a longitudinal extension dimension, be continuous along said longitudinal extension dimension.

Figure 4:
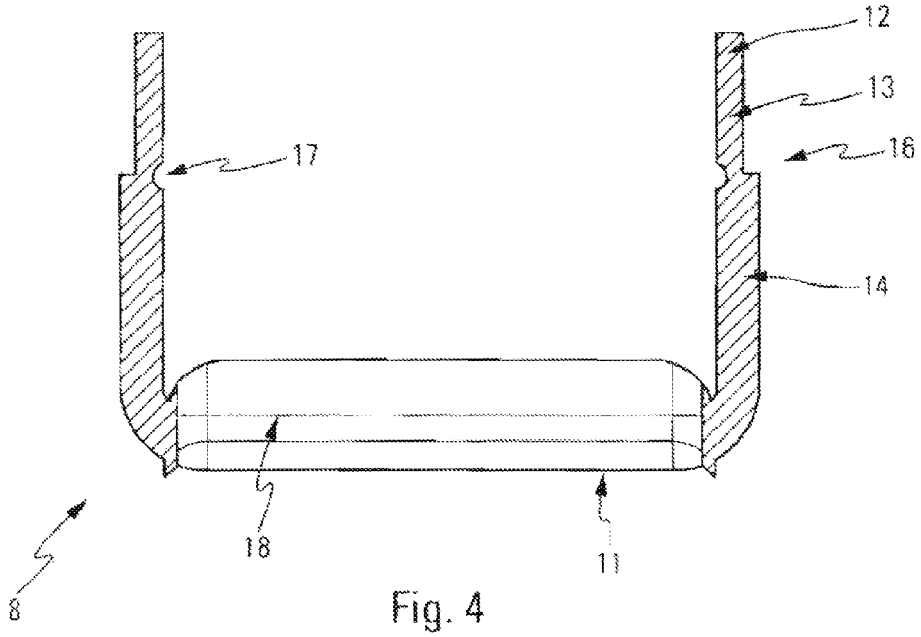
FIG. 4 is a view similar to FIG. 3, illustrating a variant embodiment.

FIG. 4 shows us an example facilitating even more the folding by crimping of the portion of peripheral edge 12 of the first part 8 onto the second part 9 by adding, in the crimping region 16, a start of fold 17. This start of fold 17 is situated, for example, on the internal side of said first part 8.

In order to best facilitate the folding by crimping of the portion of peripheral edge 12 of the first part 8 onto the second part 9 without risking breaking it, provision is made for the thinned portion 13 of said portion of peripheral edge 12 to have a thickness of between, for example, 25% and 75% of the thickness of the other portion.

More specifically, provision is made for the thinned portion 13 of the portion of peripheral edge 12 to have a thickness of between 40% and 60% of the thickness of the other portion, in particular approximately 50%.

In the case where, as illustrated, the assembly of two parts crimped together is a manifold whose cover 9 is U-shaped with a base 21 and longitudinal wings 22 linked to the base by an incurved region 23, the hinge region 16, here the base of the thinned region 13, can be situated facing the longitudinal wings 22, in proximity to the incurved region 23. In other words, the hinge region 16 is closer to the incurved region of the cover 9 than the opposite edge of said wings 22.

The invention claimed is:

1. A manifold of a heat exchanger comprising:

a collector plate;

a cover; and an assembly of two parts crimped together by folding at least one portion of a peripheral edge of one first part over a second part, wherein said first part has a hinge-forming region including a fold for facilitating the folding of said portion of said peripheral edge over said second part, wherein said portion of the peripheral edge of said first part has a thinned portion relative to another portion of said first part capable of offering a resistance to the pressure of a fluid in which a start of said fold is provided along an internal side of said first part at the level of a base of said thinned portion, wherein said base of said thinned portion also defines the interface between said thinned region and said another portion of the first part;

wherein said second part is U-shaped with a base and longitudinal wings linked to said base by an incurved region and in which an internal side of said hinge-forming region is facing said longitudinal wings in proximity to said incurved region;

wherein said assembly of said first part and said second part define an internal space and said fold faces said internal space; and wherein said collector plate constitutes said first part and said cover constitutes said second part.

2. The manifold as claimed in claim 1, in which the thinned portion extends from said hinge-forming region to the distal edge of said first part.

3. The manifold as claimed in claim 1, in which the first part has a longitudinal extension dimension and the thinned portion is continuous along said longitudinal extension dimension.

4. The manifold as claimed in claim 1, in which said thinned portion has a thickness of between 25% and 75% of the thickness of the other portion.

5. The manifold claimed in claim 1, in which said thinned portion has a thickness of between 40% and 60% of the thickness of the other portion.

6. A heat exchanger, in particular a condenser of a motor vehicle air conditioning system, provided with a manifold as claimed in claim 1.

7. The manifold as claimed in claim 1, wherein said fold is concave.

8. The manifold as claimed in claim 7, wherein said concavity of said fold is in a direction facing said internal space.

* * * * *